US007534072B1

(12) United States Patent
Scott

(10) Patent No.: US 7,534,072 B1
(45) Date of Patent: May 19, 2009

(54) SPUD CAN SURFACE WASHING APPARATUS

(76) Inventor: Christopher Scott, 404 Hesper Ave., Metairie, LA (US) 70005

( * ) Notice: Subject to any disclaimer, the term of this patent is extended or adjusted under 35 U.S.C. 154(b) by 762 days.

(21) Appl. No.: 10/983,487

(22) Filed: Nov. 8, 2004

(51) Int. Cl.
*B08B 9/02* (2006.01)

(52) U.S. Cl. ..... 405/195.1; 15/104.04

(58) Field of Classification Search ..... 15/104.04; 405/195.1, 196, 211, 211.1; 134/34, 42
See application file for complete search history.

(56) References Cited

U.S. PATENT DOCUMENTS

| | | | | | |
|---|---|---|---|---|---|
| 2,909,900 | A | * | 10/1959 | Suderow | 405/196 |
| 2,929,597 | A | | 3/1960 | Ruggieri et al. | |
| 2,960,706 | A | * | 11/1960 | Dunham | 15/4 |
| 3,183,676 | A | | 5/1965 | Tourneau | |
| 3,285,778 | A | * | 11/1966 | Hauk | 134/8 |
| 3,771,604 | A | | 11/1973 | Norman et al. | |
| 3,825,096 | A | | 7/1974 | Mendes | |
| 3,971,442 | A | * | 7/1976 | Scott | 166/380 |
| 3,999,396 | A | * | 12/1976 | Evans | 405/196 |
| 4,011,617 | A | * | 3/1977 | Toelke et al. | 15/88 |
| 4,236,733 | A | | 12/1980 | Zambrano | |
| 4,303,169 | A | | 12/1981 | Grey | |
| 4,367,858 | A | | 1/1983 | Ziaylek, Jr. | |
| 4,657,086 | A | | 4/1987 | Aanensen | |
| 4,761,097 | A | * | 8/1988 | Turner | 405/204 |
| 5,037,487 | A | * | 8/1991 | Santos | 134/22.1 |
| 5,486,069 | A | | 1/1996 | Breeden | |
| 6,340,060 | B1 | | 1/2002 | Larsson et al. | |
| 2004/0238009 | A1 | * | 12/2004 | Falster-Hansen et al. | 134/22.1 |

FOREIGN PATENT DOCUMENTS

| | | | |
|---|---|---|---|
| GB | 2098959 | A | 12/1982 |
| GB | 2243547 | A | 11/1991 |
| JP | 55122912 | A * | 9/1980 |

* cited by examiner

*Primary Examiner*—Sunil Singh
(74) *Attorney, Agent, or Firm*—Garvey, Smith, Nehrbass & North, L.L.C.; Charles C. Garvey, Jr.

(57) ABSTRACT

The present invention discloses a method and an apparatus enabling the cleaning of a jack-up vessel, particularly the lower end portion of one of its legs. The method of the present invention discloses cleaning of a jack-up vessel having a hull, a leg that extends through a hull opening surrounded by a railing includes the steps of attaching a support to the railing, the support being selectively attachable to a desire location on the railing. A monitor is mounted upon the support, the monitor having a water blasting nozzle. Water is transmitted under the pressure to the monitor and the leg is water blasted using pressurized fueled that flows through the nozzle and is directed selectively to mudded or dirtied portion of the leg to be cleaned.

19 Claims, 5 Drawing Sheets

SPUD CAN SURFACE WASHING APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine vessels (commonly referred to as jack-up vessels) that include multiple legs connected to a hull, each leg being powered with jacking mechanism to elevate the hull above a water surface. More particularly the present invention relates to a cleaning system (method and apparatus) for removing mud or other sea bottom sediment from the legs after they are elevated so that they can be fully inspected.

2. General Background of the Invention

A specialized marine work vessel is known as a jack-up platform or rig. Such a vessel has a hull and at least three legs connected to the hull. Each leg has a rack that engages one or more toothed gears or pinions driven by powerful motors. These motors and gears can elevate the hull upon the legs to a position above a water surface. The hull can then be used as a stable work platform to perform a number of tasks such as oil well drilling, maintenance, repairs and others. An example of a jack-up vessel can be seen in U.S. Pat. No. 3,183,676 and hereby incorporated herein by reference.

The lower end of each of the legs of the jack-up vessel are each typically provided with an enlarged foot or can. This lower end portion of each jack-up rig leg is designed to engage and if necessary penetrate the seabed. Often, the seabed is of a soft material such as mud, silt, clay, a combination of soft sedimentary materials or other known soft material that adheres to the leg lower end portion.

BRIEF SUMMARY OF THE INVENTION

Present invention provides a method cleaning a jack-up vessel, particularly the lower end of the leg for each of the legs. The method includes attaching a support to railing that surrounds leg openings in the hull. The support is selectively attachable to a desired location on the railing.

The method further comprises mounting a monitor with a water blasting nozzle on a support.

The combination of monitor and support are used to transmit water under pressure to the monitor and water blasting the leg lower end portion with the nozzle.

The monitor preferably has one or more swivels and the method further comprises moving the nozzle by rotating parts of the monitor at the swivels. The method can include elevating the jack-up vessel on two or more of the legs, balancing the hull and then raising one of the legs until the lower end portion of the leg is close to the monitor.

Each leg has a lower end portion with a can attached thereto and the method further comprises water blasting the can. The monitor preferably provides multiple sections attached to each other with swivels including the first swivel that enables one section to rotate relative to another section about a generally horizontal axis.

The present invention also discloses a jack-up vessel that includes a hull having a hull periphery. There are multiple vertical hull openings positioned next to the hull periphery.

At least three legs are movably attached to the hull, each leg having an outer surface and extending up and down through a leg opening.

A section of railing extends around at least one hull opening.

A monitor assembly is movably mounted upon the rail so that the monitor assembly can be selectively moved to different locations upon the rail. The monitoring includes a fueled conveying conduit.

A source of pressurized water is connectable to the monitor.

The monitor has a nozzle that is attached to and in fluid communication with the conduit. The nozzle is adjustably positioned relative to the mount portion of the monitor assembly. The nozzle is able to direct a water jet over an expansive portion of the outer surface of the leg, for washing the outer surface. A fueled inlet fitting defines a fueled flow interface between the source of pressurized water and the monitor conduit.

The monitor assembly mount portion can include one or more clamps that rigidly affix the monitor assembly to the rail.

The monitor assembly includes a railing mount and a monitor attached to the railing mount. The railing mount preferably includes front and rear space part panels. The monitor mount preferably includes means for gripping the railing.

The railing has a thickness measured generally horizontally in the rail mount front and rear panels are spaced apart a distance that is about equal to the railing thickness.

DETAILED DESCRIPTION OF THE INVENTION

Figure 1:
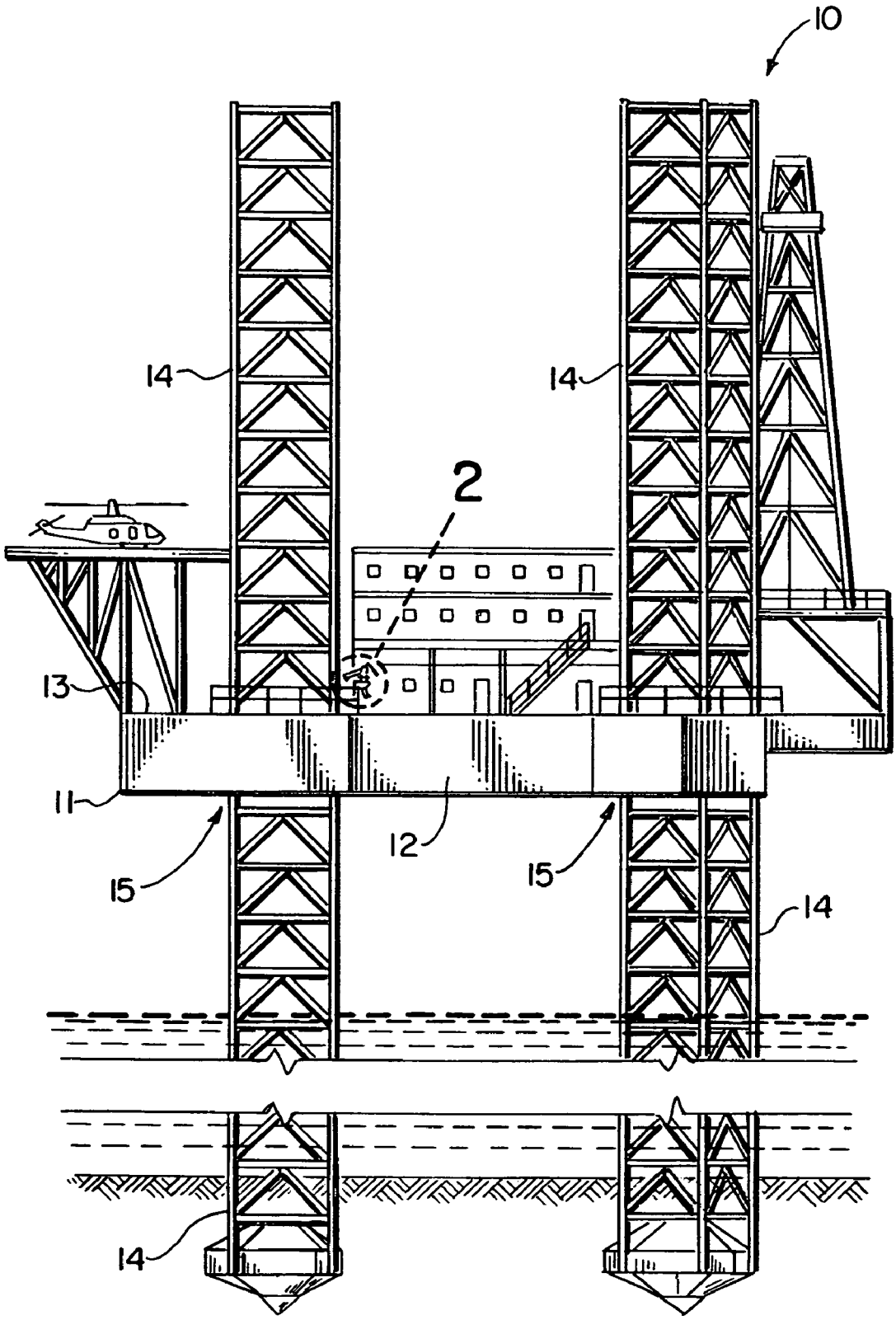
FIG. 1 is an elevation view illustrating the method of the apparatus of the present invention.
Figure 3:
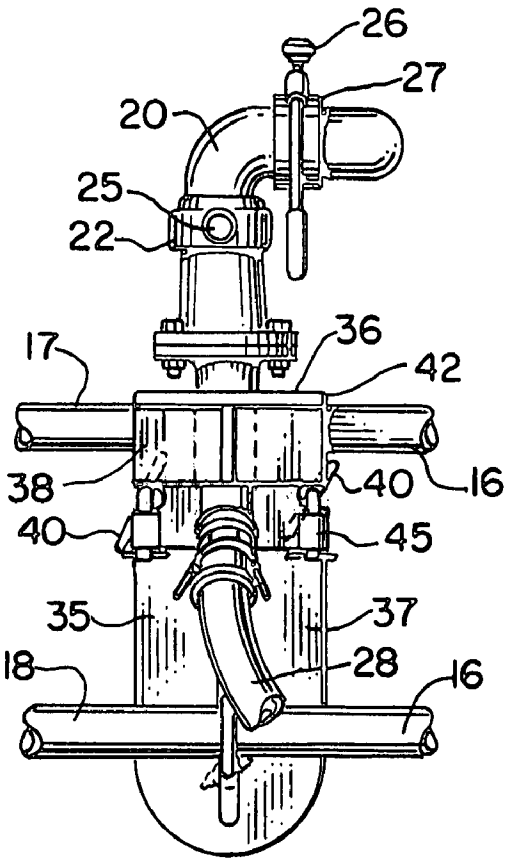
FIG. 3 is a rear view of the preferred embodiment of the apparatus of the present invention taken along lines 3-3 of FIG. 2.
Figure 2:
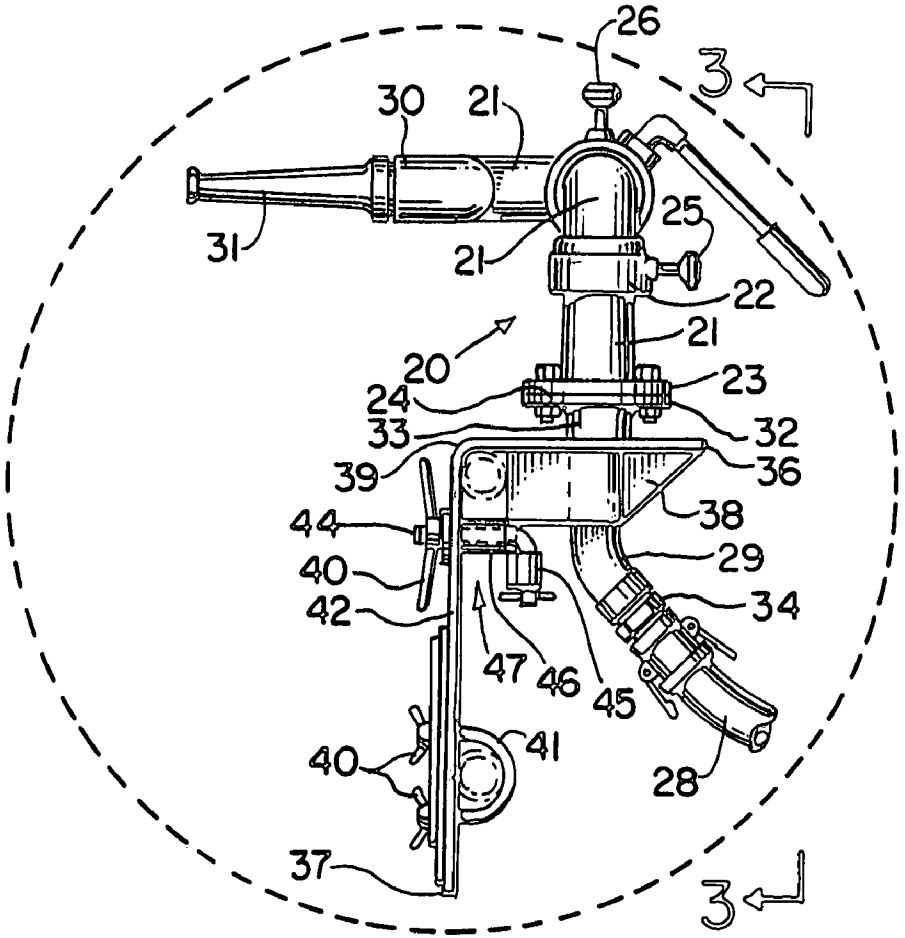
FIG. 2 is a side view of the preferred embodiment of the apparatus of the present invention.
Figure 4:
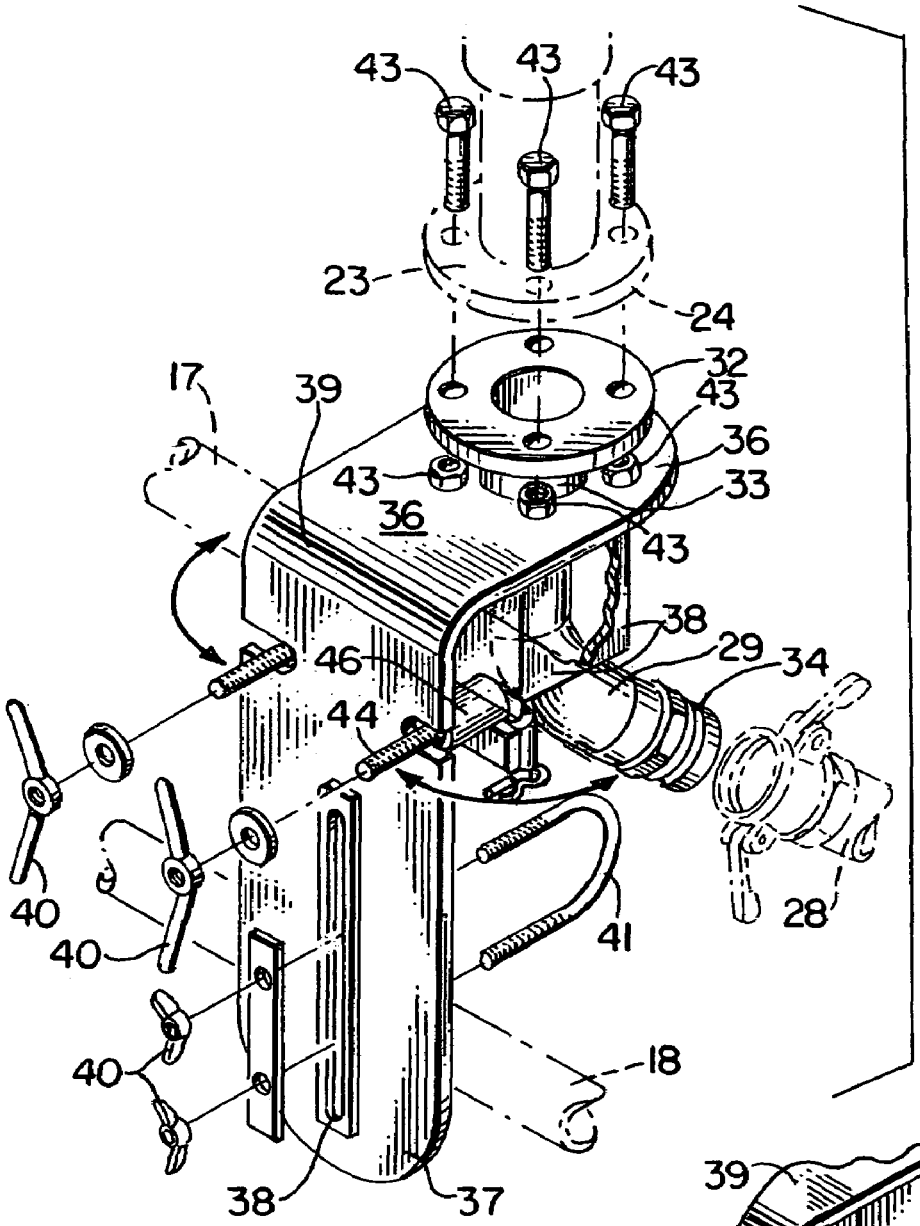
FIGS. 4-4A are fragmentary perspective views of the preferred embodiment of the apparatus of the present invention.
Figure 4A:
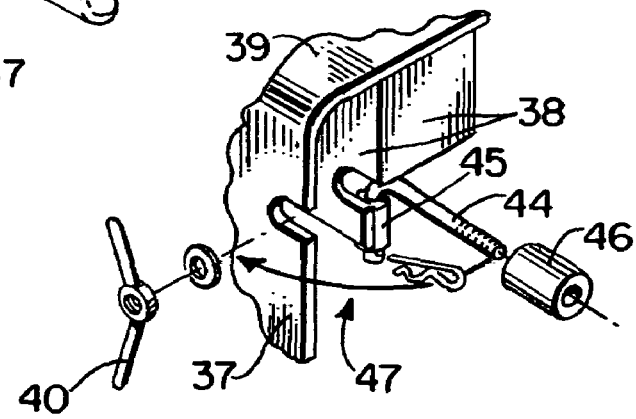

FIGS. 1 through 5 show the preferred embodiment of the apparatus of the present invention designated generally by the numeral 10 in FIGS. 1, 2, 3, 4 and 5. Spud can cleaning apparatus 10 is typically mounted on a jack-up vessel 11. Such a vessel 11 is well-known art, comprising a hull 12 having a deck 13 and a plurality of elongated legs 14. The legs 14 can be in the form of a truss as shown in the drawings. An example of such a jack-up rig can be seen in the Letourneau U.S. Pat. No. 3,183,676 and in the Breeden U.S. Pat. No. 5,486,069, each of which is incorporated herein by reference.

On such a jack-up vessel 11, the deck 13 provides hull openings 15 that accept the legs 14 as the legs 14 travel up and down during use as is known in the art. In order to protect workers from injury or death, each of the hull openings 15 is surrounded by a railing 16 that can be comprised of horizontal railing members 17, 18 and vertical railing members 19.

The apparatus 10 of the present invention provides a monitor 20 having a waterway 21. As used herein, "monitor" means a device that supports a nozzle, enabling a stream of water to be directed to a selected target area. It should be understood that monitors in general are known devices used in fire fighting. The monitor 20 can also include one or more swivels 23. Flange 23 having flange face 24. The monitor 20 swivel 22 is provided with a rotation lock 25 that locks the monitor 20, preventing rotation about a vertical axis.

Monitor 20 provides elevation lock 26 that locks the nozzle 31 portion of the monitor in a fixed elevational position so that it only directs its water jet along a single angle. Flow lines 28, 29 are used to provide a source of pressurized fluid to monitor 20 for use in water blasting the legs 14 of debris such as mud or the like. Monitor 20 provides a discharge 30 that can be fitted with nozzle 31.

Flange 32 enables attachment of monitor 20 to mount 42 and forms a connection with mount 42 at flange 23 using a bolted connection 43 for example to secure the flanges 23, 32. Mount 42 has flow line 33 that communicates with flange 32. Flow line 33 connects to flow line 29. Flow line 29 provides an inlet fitting 34 for attachment to flow line 28 (e.g. a hose) or other source of pressurized water.

Mount 42 includes housing 35 that has attached flange 32. Housing 35 preferably includes horizontal plate 36 and a vertical plate 37. The plate sections 36, 37 can be connected together using one or more gusset plate sections 38. A bend 39 defines a connection between horizontal plate section 36 and vertical plate section 37.

Housing 35 is fitted with a slot 38 receptive of a plurality of wing nuts 40 and U-bolts 41 that enable a connection to be made with a selected horizontal railing member 17 or 18 (see FIGS. 2-4 and 4A).

Wing nuts 40 can also form a connection with ell shaped fasteners 44 that are each pivotally attached at pivots 45 to a gusset plate section 38. Sleeve 46 bridges a gap 47 between gusset plate section 38 and plate section 37 (see FIGS. 2, 4 and 4A). During use, sleeve 46 rests upon rail 17.

Figure 5:
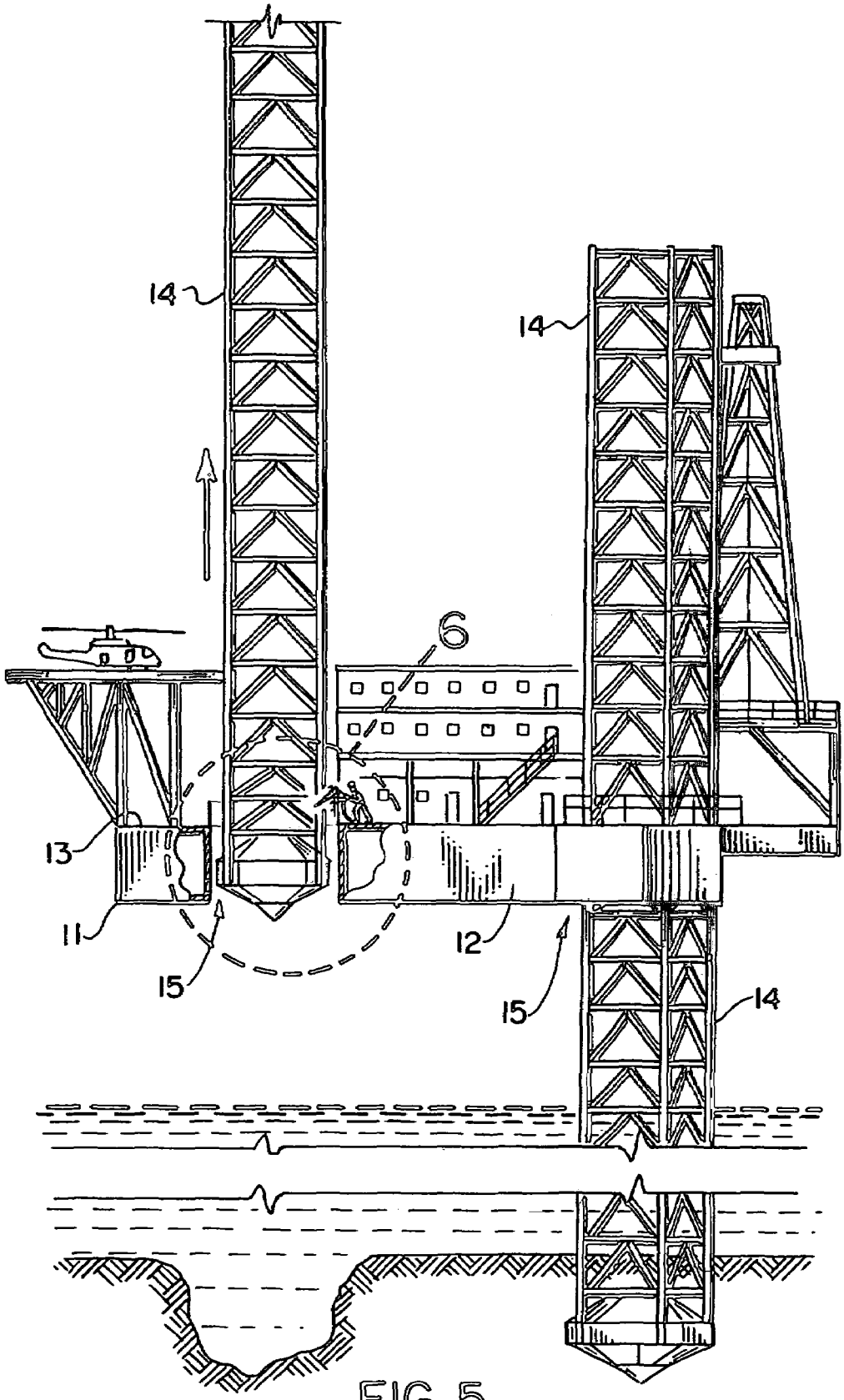
FIGS. 5-6 are elevation views of the preferred embodiment of the apparatus of the present invention.
Figure 6:
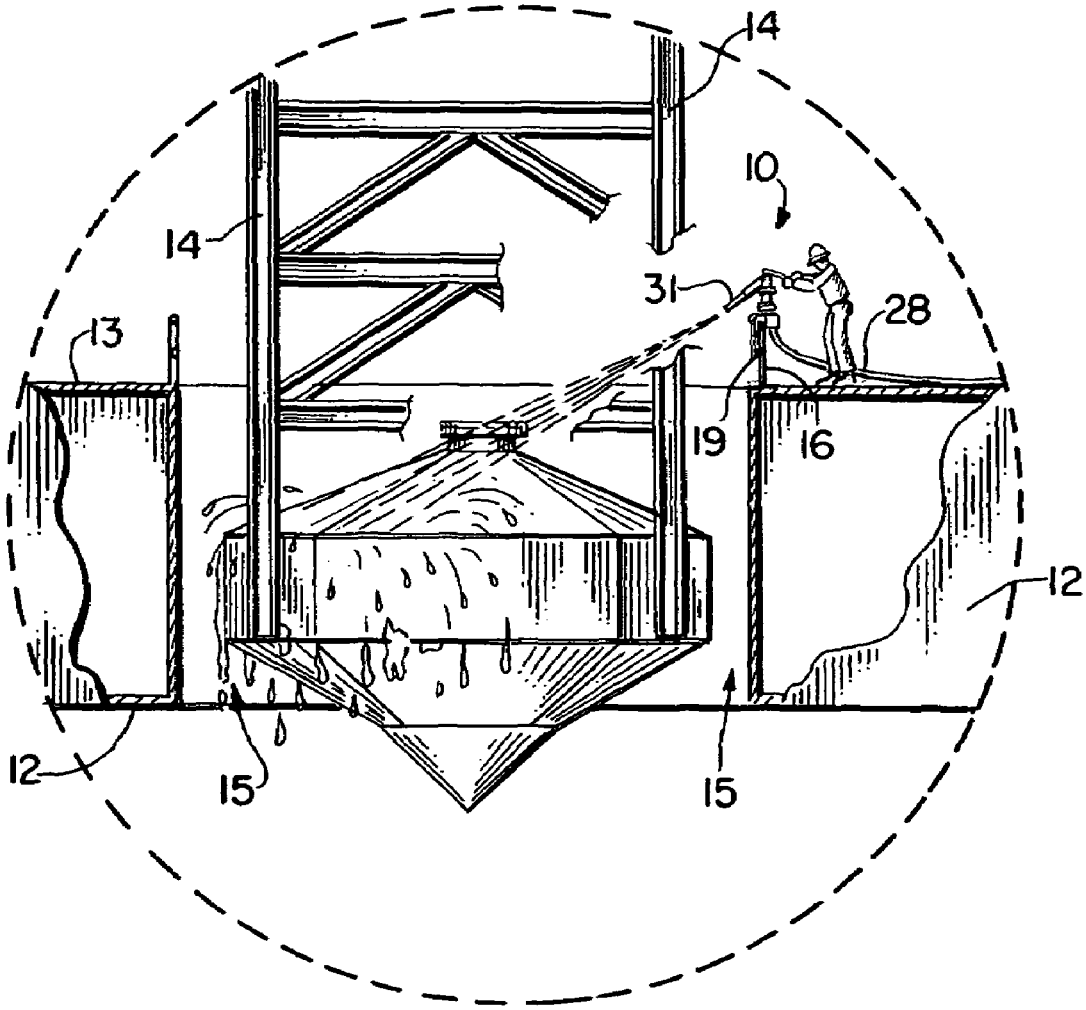

FIG. 1 shows the jack-up platform prior to the cleaning of a leg lower end portion so that the leg can be inspected. In FIG. 5, the hull 11 is ballasted so that two or three legs can support the hull 11 while the third (or fourth) leg is cleaned. Ballasting in this fashion in general is known. Once a selected leg is elevated, the method and apparatus of the present invention can be used to completely clean the leg lower end portion or can or spud can so that it can be inspected to assure that it is structurally sound.

PARTS LIST

The following is a list of parts and materials suitable for use in the present invention:

| Parts Number | Description |
|---|---|
| 10 | spud can cleaning apparatus |
| 11 | jack-up vessel |
| 12 | hull |
| 13 | deck |
| 14 | leg |
| 15 | hull opening |
| 16 | railing |
| 17 | horizontal railing member |

-continued

| Parts Number | Description |
|---|---|
| 18 | horizontal railing member |
| 19 | vertical railing member |
| 20 | monitor |
| 21 | waterway |
| 22 | swivel |
| 23 | flange |
| 24 | flange face |
| 25 | rotation lock |
| 26 | elevation lock |
| 27 | swivel |
| 28 | flow line |
| 29 | flow line |
| 30 | discharge |
| 31 | nozzle |
| 32 | flange |
| 33 | flow line |
| 34 | inlet fitting |
| 35 | housing |
| 36 | horizontal plate section |
| 37 | vertical plate section |
| 38 | gusset plate section |
| 39 | bend |
| 40 | wingnut |
| 41 | u-bolt |
| 42 | mount |
| 43 | bolted connection |
| 44 | ell shaped fastener |
| 45 | pivot |
| 46 | sleeve |
| 47 | gap |

The foregoing embodiments are presented by way of example only; the scope of the present invention is to be limited only by the following claims.

The invention claimed is:

1. A method of cleaning a jack-up vessel having a hull, a leg that extends through a hull opening surrounded by a railing, comprising the steps of:

a) attaching a support to the railing, the support being selectively attachable to a desired location on the railing;

b) mounting a monitor with a water blasting nozzle on the support;

c) transmitting water under pressure to the monitor; and d) water blasting the leg lower end portion with the nozzle.

2. The method of claim 1 wherein the monitor has one or more swivels and further comprising moving the nozzle by rotating parts of the monitor at one or more of the swivels.

3. The method of claim 1 further comprising the step of elevating the jack-up vessel and raising one of the legs until the lower end portion of the leg is close to the monitor.

4. The method of claim 1 wherein each leg has a lower end portion with a can attached thereto and further comprising water blasting the can in step "d".

5. The method of claim 1 wherein the monitor has multiple sections attached to each other with swivels including a first swivel that enables one section to rotate relative to another section about a generally horizontal axis.

6. The method of claim 1 wherein the monitor has multiple sections attached to each other with swivels including a first swivel that enables one section to rotate relative to another section about a generally vertical axis.

7. The method of claim 1 further comprising rotating the nozzle about multiple axes in step "d".

8. The method of claim 7 further comprising rotating the nozzle about both generally horizontal and generally vertical axes.

9. The method of claim 1 further comprising moving the monitor support and monitor to multiple positions on the railing.

10. A jack-up vessel, comprising:

a) a hull having a hull periphery and multiple vertical hull openings next to the periphery;

b) at least three legs movably attached to the hull, each leg having an outer surface and extending up and down through a hull opening;

c) a section of railing extending around at least one hull opening;

d) a monitor assembly that includes a railing mount movably mounted on the section of railing so that the monitor assembly can be selectively moved to different selected locations upon the section of railing, the monitor assembly having a fluid conveying conduit;

e) a water source of pressurized water connectable to the monitor;

f) wherein the monitor assembly has a nozzle that is attached to and in fluid communication with the water source and is adjustably positioned relative to the mount, enabling the nozzle to direct a water jet over an expansive portion of the outer surface of a selected leg of the three legs, washing said outer surface; and g) a fluid inlet fitting that defines a fluid flow interface between the source of pressurized water and the monitor conduit.

11. The jack-up vessel of claim 10 wherein the monitor assembly mount includes one or more clamps that rigidly affix the monitor assembly to the section of railing.

12. The jack-up vessel of claim 10 wherein the railing mount includes front and rear spaced apart panels.

13. The jack-up vessel of claim 10 wherein the railing mount includes means for gripping the section of railing.

14. The jack-up vessel of claim 10 wherein the section of railing has a thickness measured generally horizontally and the rail mount has front and rear panels that are spaced apart a distance that is about equal to the section of railing thickness.

15. The jack-up vessel of claim 14 wherein the section of railing has a thickness measured generally horizontally and the rail mount front and rear panels are spaced apart a distance that is greater than the railing thickness.

16. The jack-up vessel of claim 10 wherein the fluid inlet fitting is mounted upon the railing mount.

17. The jack-up vessel of claim 10 further comprising a handle for manually adjusting the position of the nozzle relative to the outer surface of the at least three legs.

18. The jack-up vessel of claim 10 wherein the section of railing includes multiple generally horizontally extending and vertically spaced apart railing sections, and the monitor assembly is connected to multiple of the railing sections during use.

19. The jack-up vessel of claim 10 wherein the section of railing includes multiple generally horizontally extending and vertically spaced apart railing sections, and the monitor assembly is connected to multiple of the railing sections during use.

* * * * *